US006482049B1

(12) United States Patent
Swearingen

(10) Patent No.: US 6,482,049 B1
(45) Date of Patent: Nov. 19, 2002

(54) RADIALLY RESILIENT ELECTRICAL CONNECTOR

(75) Inventor: Dean D. Swearingen, Clinton Township, MI (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 09/615,290

(22) Filed: Jul. 13, 2000

Related U.S. Application Data

(60) Provisional application No. 60/144,137, filed on Jul. 16, 1999.

(51) Int. Cl.[7] ..... H01K 13/187
(52) U.S. Cl. ..... 439/843; 439/851
(58) Field of Search ..... 439/843, 750, 439/844, 851; 200/16

(56) References Cited

U.S. PATENT DOCUMENTS

| | | | | |
|---|---|---|---|---|
| 1,833,145 | A | 11/1931 | Wilhelm | |
| 3,396,364 | A | 8/1968 | Bonhomme | 339/217 |
| 3,470,527 | A | 9/1969 | Bonhomme | 339/256 |
| 3,517,374 | A | 6/1970 | Bonhomme | 339/176 |
| 3,557,428 | A | 1/1971 | Bonhomme | 29/203 |
| 3,626,361 | A | 12/1971 | Bonhomme | 339/217 |
| 3,641,483 | A | 2/1972 | Bonhomme | 339/217 |
| 3,686,622 | A | 8/1972 | Bonhomme | 339/217 |
| 3,808,589 | A | 4/1974 | Bonhomme | 339/217 |
| 3,858,962 | A | 1/1975 | Bonhomme | 339/256 |
| 4,128,293 | A | 12/1978 | Paoli | 339/258 |
| 4,175,821 | A | 11/1979 | Hunter | 339/258 |
| 4,203,647 | A | 5/1980 | Bonhomme | 339/256 |
| 4,657,335 | A | 4/1987 | Koch et al. | 339/256 |
| 4,720,157 | A | 1/1988 | Nestor et al. | 438/851 |
| 4,734,063 | A | 3/1988 | Koch et al. | 439/844 |
| 4,902,235 | A | 2/1990 | Tonooka | 439/72 |
| 5,033,982 | A | 7/1991 | Lucas | 439/750 |
| 5,108,318 | A | 4/1992 | Sakurai et al. | 439/744 |
| 5,147,229 | A | 9/1992 | Nestor | 439/843 |
| 5,326,289 | A | 7/1994 | Leisey | 439/851 |
| 5,378,552 | A | 1/1995 | Dixon et al. | 429/91 |
| 5,416,286 | A | 5/1995 | Dixon et al. | 200/16 |
| 5,511,307 | A | 4/1996 | Reiersgaard et al. | 29/863 |
| 5,607,328 | A | 3/1997 | Joly | 439/852 |
| 5,662,497 | A | 9/1997 | Reilly | 439/627 |
| 5,735,716 | A | 4/1998 | Bilezikjian | 439/843 |
| 6,250,974 | B1 | 6/2001 | Kerek | 439/843 |

FOREIGN PATENT DOCUMENTS

| | | |
|---|---|---|
| GB | 1136589 | 12/1968 |
| GB | 2065993 | 7/1981 |
| WO | WO 98/43321 | 10/1998 |

*Primary Examiner*—P. Austin Bradley
*Assistant Examiner*—Alexander Gilman
(74) *Attorney, Agent, or Firm*—Young & Basile, P.C.

(57) ABSTRACT

A radially resilient connector is fixedly mounted at one end in a cup shaped recess in a terminal. A cap is fixed over the other end of the connector and rotated with respect to the terminal to angularly offset the opposed ends of the contact member of the connector. The cap is then fixed to the terminal. In one aspect, the connector has two outer sleeves mounted over opposite ends. A tab on one sleeve engages an aperture in the other sleeve after one of the sleeves is angularly offset with respect to the other sleeve. In another aspect, an inner sleeve of the connector is formed with an electrically insulating material, radially extending projection extending therefrom dividing the outer sleeve into two separate conductive parts. An electrical circuit connected to one of the outer sleeves causes current to flow through the contact member to the other sleeve portion to generate heat within the connector. The connector is also useable in a disconnect by connecting two contacts spaceably mounted on an insulating member in a housing and connected to separate external circuits. A cartridge insertion tool is also disclosed for mounting a connector cartridge and a bore and a use element.

11 Claims, 9 Drawing Sheets

RADIALLY RESILIENT ELECTRICAL CONNECTOR

CROSS-REFERENCE TO CO-PENDING APPLICATION

This application claims that the benefit of the priority date of copending United States Provisional Patent Application, Ser. No. 60/144,137, filed Jul. 16, 1999, and entitled "Radially Resilient Electrical Connector", the contents of which are incorporated herein in their entirety.

BACKGROUND OF THE INVENTION

1. Field of the Invention

The present invention relates, in general, to electrical connectors and, more specifically, to radially resilient electrical sockets, also referred to as barrel terminals, in which a solid, cylindrical electrical prong or pin is axially inserted into a socket whose interior surface is defined by a plurality of contact strips or wires mounted within a cylindrical sleeve and inclined between angularly offset ends.

2. Description of the Art

Radially resilient electrical sockets or barrel terminals are a well known type of electrical connector as shown in U.S. Pat. Nos. 4,657,335 and 4,734,063, both assigned to the assignee of the present invention.

In such electrical sockets or barrel terminals, a generally rectangular stamping is formed with two transversely extending webs spaced inwardly from and parallel to opposite end edges of the sheet. Between the inner side edges of the transverse web, a plurality of uniformly spaced, parallel slots are formed to define a plurality of uniformly spaced, parallel, longitudinally extending strips which are joined at opposite ends to the inward side edges of both transverse webs. Other longitudinally extending slots are coaxially formed in the sheet and extend inwardly from the end edges of the blank to the outer side edges of the transverse webs to form a plurality of uniformly spaced, longitudinally extending tabs projecting outwardly from each transverse web.

The blank or sheet is then formed into a cylinder with the longitudinal strips extending parallel to the axis of the now cylindrical sheet. A closely fitting cylindrical sleeve is slipped coaxially around the outer periphery of the cylindrical blank, and extends axially substantially between the outer edges of the transverse webs. The mounting tabs at each end of the blank are then bent outwardly across end edges of the sleeve into radially extending relationship to the sleeve.

A relatively tight-fitting annular collar or outer barrel is then axially advanced against the radially projecting tabs at one end of the sleeve and slipped over the one end of the sleeve driving the tabs at that end of the sleeve downwardly into face-to-face engagement with the outer surface of the one end of the sleeve. The fit of the annular collar to the sleeve is chosen so that the end of the cylindrical blank at which the collar is located is fixedly clamped to the sleeve against both axial or rotary movement relative to the sleeve. A tool typically having an annular array of uniformly spaced, axially projecting teeth is then engaged with the radially projecting tabs at the opposite end of the sleeve. The teeth on the tool are located to project axially between the radially projecting tabs closely adjacent to the outer surface of the cylindrical sleeve. The tool is then rotated about the longitudinal axis of the cylindrical sleeve while the sleeve is held stationary to rotatably displace the engaged tabs approximately 15° to 45° from their original rotative orientation relative to the sleeve and the bent over tabs at the opposite end of the sleeve. A second annular collar or outer barrel is then fitted over the tabs and the sleeve to fixedly locate the opposite end of the blank in a rotatably offset position established by the tool before the tool is withdrawn. When completed, such an electrical socket has longitudinal strips extending generally along a straight line between the angularly offset locations adjacent the opposite ends of the cylindrical sleeve. The internal envelope cooperatively defined by the longitudinal strips is a surface of revolution coaxial to the axis of the cylindrical sleeve having equal maximum radii at the points where the strips are joined to the respective webs and a somewhat smaller radius midway of the length of the strips. The minimum radius, midway between the opposite ends of the strips, is selected to be slightly less than the radius of a cylindrical connector pin which is to be inserted into the barrel socket so that the insertion of the pin requires the individual longitudinal strips to stretch slightly longitudinally to firmly frictionally grip the pin when it is seated within the barrel socket.

To put it another way, because of the angular offset orientation of the opposed ends of each of the strips, each strip is spaced from the inner wall of the sleeve in a radial direction progressively reaching a maximum radial spacing with respect to the outer sleeve midway between the ends of the sleeve.

Such a radially resilient electrical barrel socket provides an effective electrical connector which provides secure engagement with an insertable pin; while still enabling easy manual withdrawal or insertion of the pin relative to the socket. Such connectors also provide a large electrical contact area between the pin and the socket which enables such connectors to be employed in high current applications.

Due to the advantages afforded by such a radially resilient electrical connector, it would be desirable to provide new applications for the radially resilient electrical socket or connector.

SUMMARY OF THE INVENTION

The present invention is a radially resistent connector formed as a cartridge having a sleeve surrounding a contact member formed of a plurality of spaced strips, with one end of the strips angularly offset from the other end of the strips.

According to one aspect of the invention, an electrical connector includes a cylindrical sleeve, and a contact member coaxially received within the sleeve. The contact member includes a plurality of circumferentially spaced strips having first and second ends, with one of the first and second ends of each strip being angularly offset with respect to a longitudinal axis of the sleeve from the opposed ends of the respective strip. The first and second ends of the strips are non-moveably fixed in the angularly offset position with respect to the sleeve.

In another aspect, the cartridge is mountable in an electrical terminal. The mounting means comprises welds, tabs which are crimped around the edge of the terminal, tabs on the terminal which are bendable over the ends of the mounting flange, tabs in the mounting flange which are formed into enlarged heads extending through apertures in the terminal.

In another aspect, the connector is useable in an electrical disconnect in which two electrical contact members insulatingly spaced apart on a insulating member.

A housing surrounds the spaced contacts and defines a cavity between the housing and the spaced contacts. The connector is releasably insertable into the housing and electrically connects the two contacts. In this aspect, the first contact is connected to a first external electrical circuit and the second electrical contact is connected to a second external electrical circuit. Further, an insulating member connected to the connector to facilitate insertion and removal of the connector with respect to the housing.

A cartridge insertion tool is also provided for the connector. The too includes a cylindrical sleeve, and a contact member coaxially received within the sleeve. The contact member is formed of a plurality of circumferentially spaced strips having first and second ends, one of the first and second ends of each strip being angularly offset with respect to a longitudinal axis of the sleeve from the opposed end of the respective strip. The first and second ends of the strips are non-moveably fixed in the angularly offset position with respect to the sleeve.

The insertion tool also includes a housing having a through bore, a slider notably mounted in the through bore, and a transverse opening in the housing communicating with the bore for insertion of the connector therein.

Advance of the slider in the bore urges the connector into a bore in a use element located at the end of the housing.

The radially resilient electrical connector of the present invention is useable in a number of different applications without modification to the connector. The use of the insertion tool allows the connector to be installed in a use element in the field, rather than at the manufacturing facility of the use element. This facilitates repair and replacement of the connector as well as its use in various use elements.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

The structure of a barrel socket used in an electrical connector according to one or more aspects of the present invention is best explained by a description of the manner in which it is manufactured.

Figure 1:
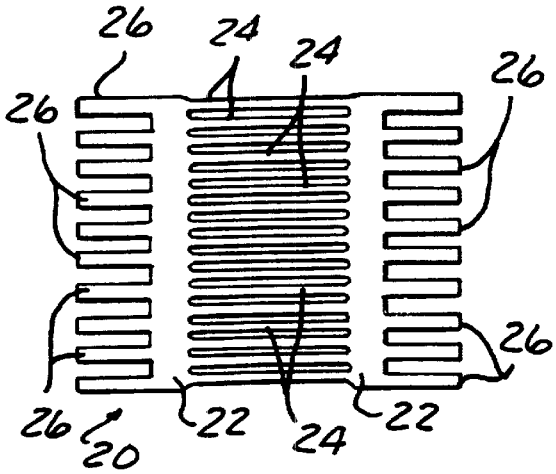
FIG. 1 is a plan view of a flat sheet metal blank employed in constructing a barrel terminal embodying the present invention.

The first step in the manufacture of the barrel socket is the stamping of a blank in the form shown in FIG. 1 from a flat piece of sheet metal which preferably is a beryllium copper alloy which has both mechanical and electrical properties well adapted for this application.

Referring to FIG. 1, the blank designated generally 20 is stamped in a generally rectangular configuration and formed with a pair of spaced, parallel, transversely extending connecting web portions 22 which are integrally connected to each other by a plurality of uniformly spaced, parallel, longitudinally extending strips 24 which extend between the respective inner edges of the webs 22. A plurality of spaced, parallel tabs 26 project longitudinally outwardly from the outer edges of the respective transverse webs 22.

Figure 2:
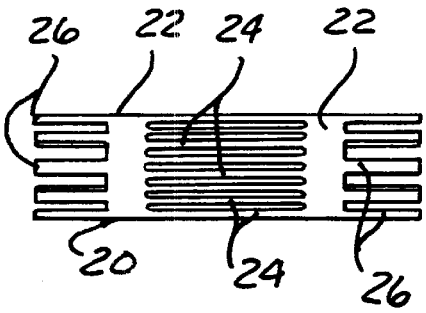
FIG. 2 is a side elevational view of the blank of FIG. 1 formed into a cylinder.

The second step in the manufacturing process is shown in FIG. 2 and finds the blank 20 formed into a horizontal, cylindrical, tubular configuration, the axis of the cylindrical tube extending parallel to the longitudinal strips 24 and tabs 26.

Figure 3:
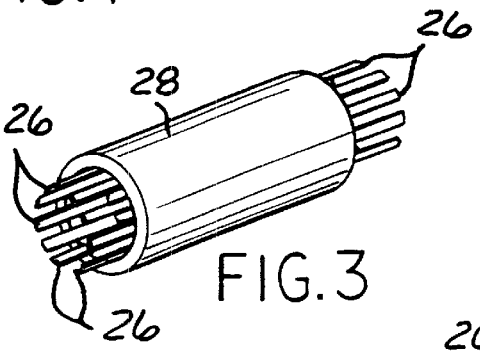
FIG. 3 is a perspective view showing a close fitting cylindrical sleeve disposed about the blank of FIG. 2.

After the blank 20 is formed into the cylindrical tubing configuration of FIG. 2, a close-fitting cylindrical sleeve 28 is slipped over the tube as shown in FIG. 3, the axial length of sleeve 28 being sufficient to extend over both of the transverse webs 22 leaving the tabs 26 projecting outwardly from the opposite ends of sleeve 28.

Figure 4:
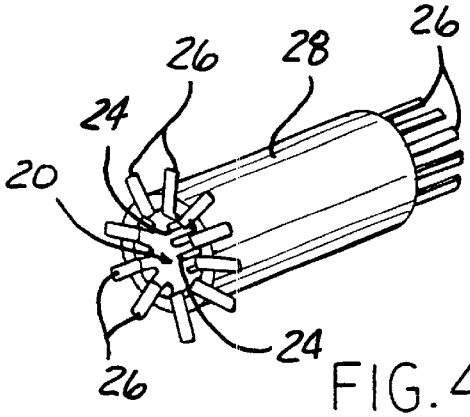
FIG. 4 is a perspective view of a subsequent step in the construction of the barrel terminal.

In the next step shown in FIG. 4, the projecting tabs 26 are flared or bent outwardly across one end edge of sleeve 28 to project radially outwardly of the axis of the sleeve.

Figure 5:
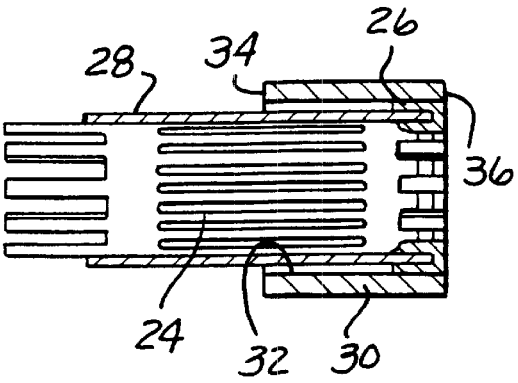
FIG. 5 is an enlarged side elevational, cross-sectional view showing a subsequent step in the present construction method.

In the next step of the process shown in FIG. 5, a temporary first housing or fixture 30 has a central bore 32 extending at least from a first end 34 to an opposite end 36. The bore 32 has a diameter larger than the diameter of the cylindrical sleeve 28 by a distance equal to the thickness of the tabs 26. The first housing 30 is axially driven over one end of the sleeve 28 or the sleeve 28 is axially driven into one of the first and second ends 34 and 36 of the first housing 30. The forcible interconnection of the sleeve 28 and the first housing 30 bends the radially flared tabs 26 at the one end of the sleeve 28 back on themselves into overlapping, face-to-face relationship with the outer surface of the sleeve 28. The inner diameter of the bore 32 is chosen such that when the first housing 30 and the first end of the blank 20 and the sleeve 28 are in the position shown in FIG. 5, the first housing 30 exerts sufficient force on the tabs 26 to clamp the tabs 26 against the outer surface of the sleeve 28 to prevent any axial or rotary movement of the tabs 26 relative to the sleeve 28.

Figure 6:
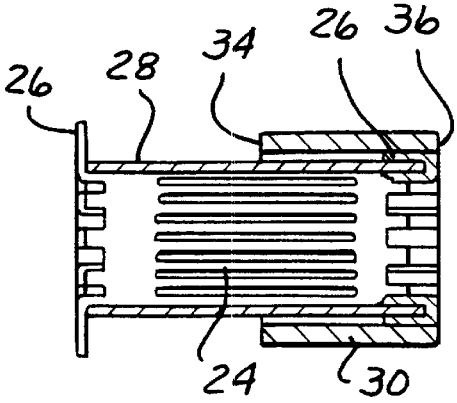
FIG. 6 is an enlarged side elevational, cross-sectional view showing yet another step in the construction method of the present invention.

Next, as shown in FIG. 6, the tabs 26 at the opposite end of the sleeve 28 are flared or bent radially outwardly across the opposite end edge of the sleeve 28 to project radially outward from the axis of the sleeve 28.

Figure 7:
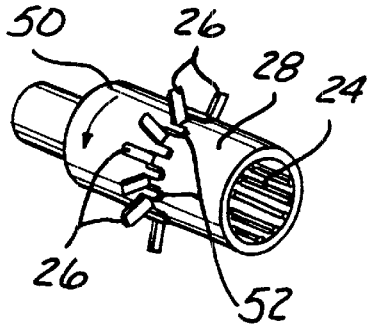
FIG. 7 is a perspective view depicting another step in the construction method of the present invention.

In the next step shown in FIG. 7, a tubular tool 50 having uniformly spaced, axially projecting teeth 52 on one end is engaged with the ends of the radially projecting tabs 26 within one end of the sleeve 28. The outer diameter of the tool 50 is such that it will have a loose, sliding, snug fit with the inner diameter of the sleeve 28 and the teeth 52 are so spaced from each other so as to project through the spaces between the adjacent, tabs 26.

When the tool 50 is seated with the teeth 52 between the radially projecting tabs 26, the first housing 30 is clamped or otherwise held against rotation and the tool 50 rotated coaxially of the sleeve 28 through a predetermined angle, which is typically from about 15° to about 45°, with a 20° offset being nominal. This action of the tool 50 rotatably offsets one end of the blank or sheet 20 from the previously fixed end held against rotation by the first housing 30 relative to the sleeve 28. The characteristics of the beryllium copper alloy of which the blank or sheet 20 is preferably made is such that, although the material possesses some resiliency, the rotation imparted by the tool 50 permanently sets the blank 20 in the rotated position.

Figure 8:
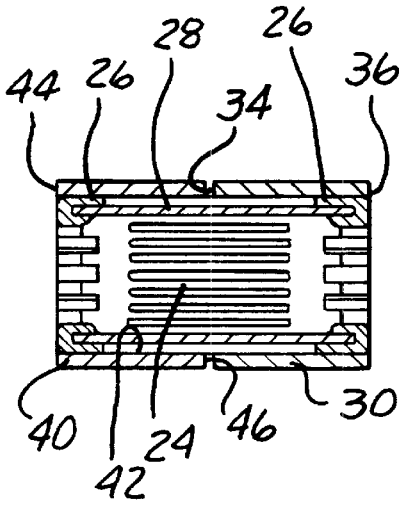
FIG. 8 is a side elevational, longitudinal cross-sectional view of the temporary assembled state of the barrel terminal of the present invention.

Next, as still shown in FIG. 8, while still held in a twisted state, a second housing 40 also having a through bore 42 extending from a first end 44 to an opposed second end 46 is axially driven over the sleeve 28 into interference with the radially outward extending tabs 26 or the ends of the sleeve 28 and the blank 20 extending outward from the first housing 30 are axially driven into the bore 42 in the second housing 40. The second housing 42 is then advanced relative to the first housing 30 to force fit the interior surfaces of the bore 42 in the second housing 40 into engagement with the radially extending, angularly offset tabs 26 thereby bending the tabs 26 over into face-to-face engagement with the outer surface of the other end of the sleeve 28.

The second housing 40 and the first housing 30 are advanced relative to one another into abutment to hold the angularly offset tabs 26 at each end of the sleeve 28 non-movably against the outer surface of the sleeve 28.

Figure 9:
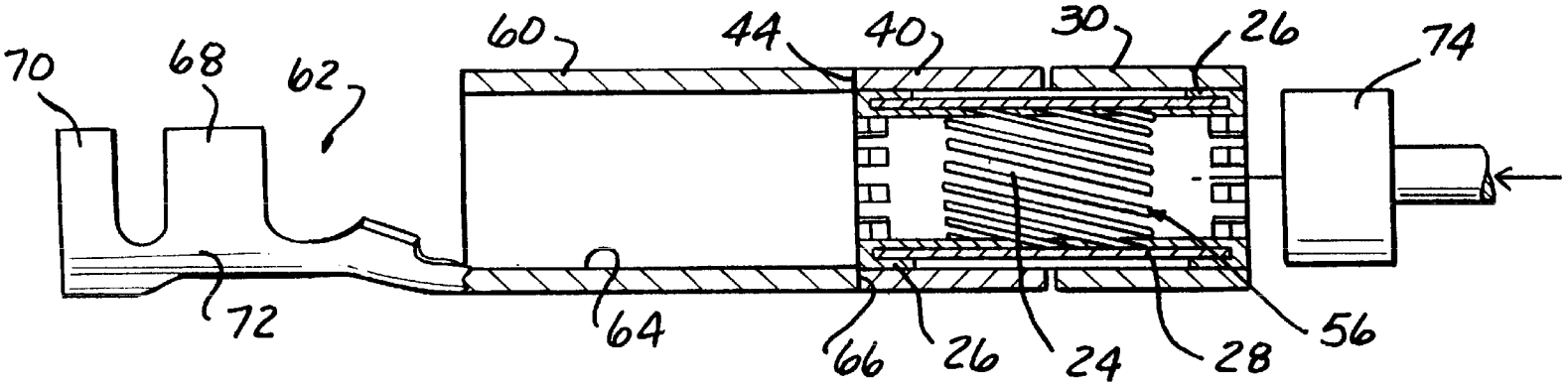
FIG. 9 is an enlarged, side elevational, cross-sectional view of the next step in the construction method of the present invention.

Turning now to FIG. 9, the completed barrel socket denoted by reference number 56, and the coaxially aligned first and second housings 30 and 40 which house the barrel socket 56 are then coaxially aligned with one end of a cylindrical portion 60 of a holder, support or electrical use device 62. In the embodiment shown in FIG. 9 by way of example only, the holder or support 62 is illustrated in a form of a terminal having the cylindrical portion 60 at one end with a through bore 64 projecting from an open end 66 and a pair of bendable collar members 68 and 70 which are integrally formed with an elongated support 72 and which are bendable about an inserted pin or electrical conductor to electrically connect the pin or electrical conductor to the barrel socket 56.

Figure 10:
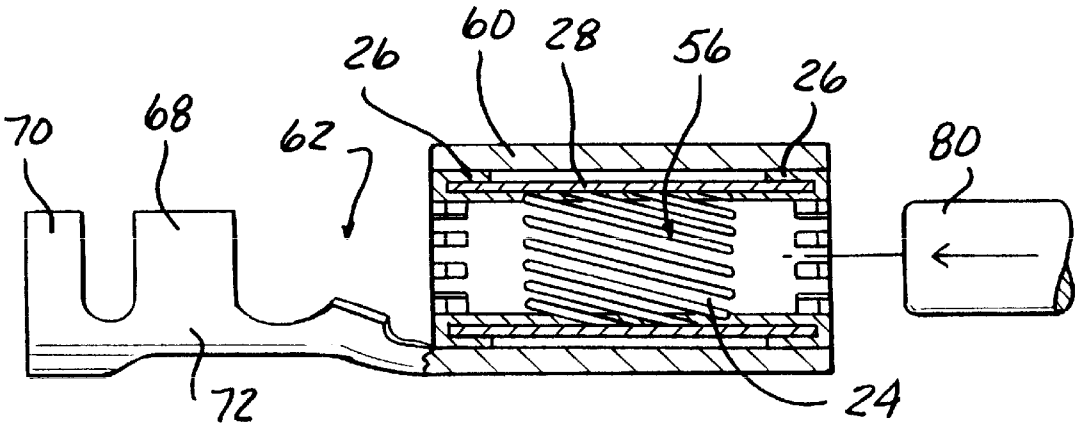
FIG. 10 is an enlarged, side elevational, cross-sectional view of the assembled electrical connector of the present invention.

As shown in FIG. 9, when the first and second housings 30 and 40 are coaxially aligned with the end 66 of the cylindrical portion 60 of the holder 62, a pusher 74, such as a fluid cylinder or motor driven rod, is advanced through the open end of the first housing 30 into engagement with one end of the barrel socket 56. The pusher 74 pushes the entire barrel socket 56 from the first and second housings 30 and 40 and into the bore 64 of the cylindrical portion 60 of the holder 62 as depicted in FIG. 10 without any loss of holding force on the tabs 26. The inner diameter of the bore 64 in the cylindrical portion 60 is such that the bent over tabs 26 are held in secure, non-axial, non-rotative engagement with the outer surface of the sleeve 28. The barrel socket 56 when mounted in the cylindrical portion 60 of the holder 62 is now ready to receive an external elongated pin or prong 80, as shown in FIG. 10. The diameter of the cylindrical pin 80 is slightly less than the internal diameter of the transverse webs 24 when seated in the sleeve 28, and somewhat greater than the minimum radius of the entire envelope defined by the rotatably offset longitudinal strips 24 of the barrel socket 56. When the pin 80 is fully inserted into the sleeve 28, the pin 80 forces the individual strips 24 to stretch somewhat longitudinally so that the strips 24 can be moved radially outwardly toward the inner surface of the sleeve 28 a sufficient distance to accommodate the insertion of the pin 80. The inner surface of the strips 24, particularly midway of the opposite ends thereof, thus lie tightly against the outer surface of the pin 80 to maintain a firm frictional grip on the pin 80 sufficient to mechanically maintain a connection in the face of normally encountered removal forces. However, the frictional grip is not so tight as to prohibit relatively easy manual withdrawal of the pin 80 from the cylindrical portion 60 of the holder 62.

Referring now to FIGS. 14–18, there is depicted the construction steps according to another aspect of the method of the present invention for manufacturing an electrical connector utilizing a radially resilient barrel socket.

Figure 14:
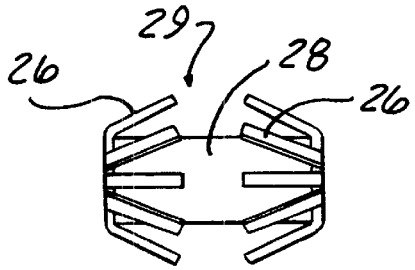
FIGS. 14–17 depict sequential steps in an alternate construction method a barrel socket according to the present invention.
Figure 15:
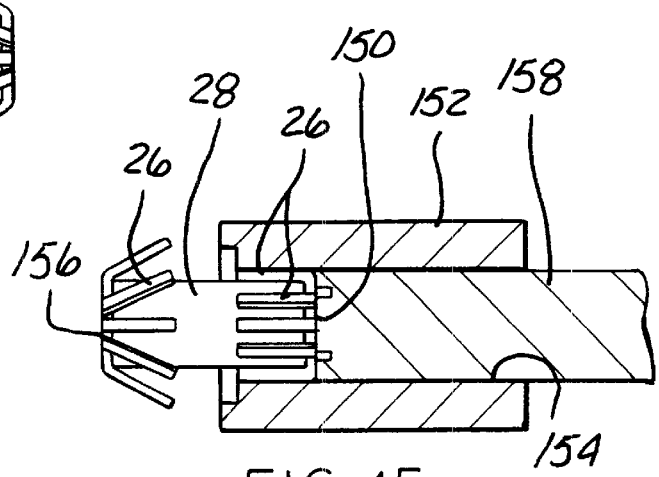

In FIG. 14, the sleeve 28 is depicted. This construction stage is similar to that described above and shown in FIG. 4 in which the blank 20 has been bent or formed into a cylinder and the outer sleeve 28 disposed closely thereover with the tabs 26 projecting outward from opposite ends of the sleeve 28 as shown in FIG. 3.

However, in this aspect of the present invention, the tabs 26 at both ends of the sleeve 28 are bent or folded around the outer ends of the sleeve 28 and back over the outer surface of the sleeve 28 to form a cartridge 29.

The first end 150 of the cartridge 29 is then inserted into a first housing or fixture 152 having a bore 154 formed therein. The inner diameter of the bore 154 is sized slightly larger than the outer diameter of the sleeve 28 by a distance equal to the thickness of the tabs 26 so as to closely fold over the tabs 26 into face-to-face engagement with the outer surface of the sleeve 28 when the first end 150 of the cartridge 29 is inserted into the first housing 152. It should be noted that the cartridge 29 is only partially inserted into the bore 154 in the first housing 152 such that the second end 156 of the sleeve 28 projects outwardly from the first housing 152 along with the tabs 26 at the second end 156 of the sleeve 28.

The first end 150 of the cartridge 29 is inserted into the bore 154 in the first housing 152 until the first end 150 engages one end of a rotatable tool 158 which is rotatably disposed within the bore 154. The tool 158 can be similar to the tool 50 described above and shown in FIG. 7 and has teeth which engage the spaces between adjacent folded over tabs 26 at the first end 150 of the sleeve 28.

Figure 16:
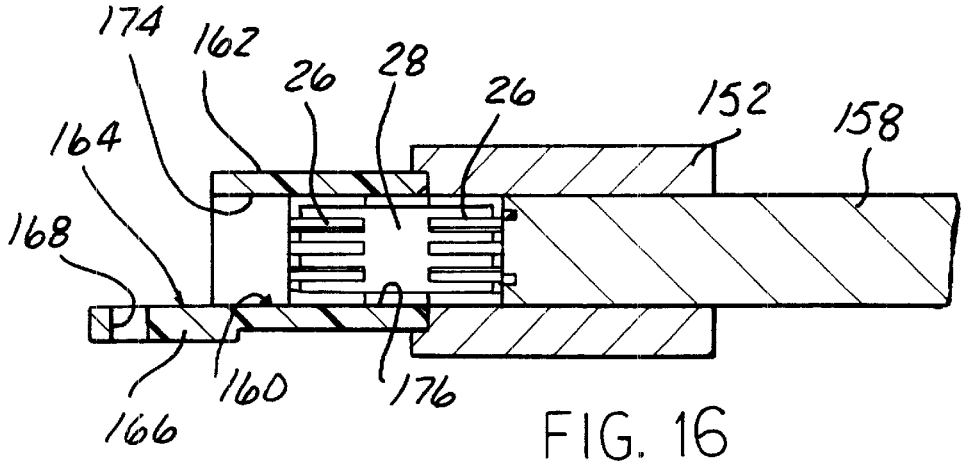

Next, as shown in FIG. 16, the second end 156 of the cartridge 29 is inserted into or otherwise brought into engagement with a bore 160 in a cylindrical portion 162 of a terminal, holder, support or electrical device, all referred to generally hereafter as a holder 164. The cylindrical portion 162 is disposed at one end of a support or base 166, the opposite end of which, by example only, includes an aperture 168 for receiving a fastener 170, shown in FIG. 18, to secure another terminal 172 carrying an electrical conductor, again by example only, to the holder 164.

According to a preferred aspect of the present invention, the bore 160 in the cylindrical portion 162 is divided into two sections, namely, a first end section 174 and a second end section 176. The inner diameter of the first end section 174 is selected to create a press or interference fit with the tabs 26 at the second end 156 of the cartridge 29 when the second end 156 of the cartridge 29 is inserted into the bore 160. The second end section 176 of the bore 160 has a larger diameter than the first end section 174 to enable the second end 156 and the folded tabs 26 on the outer sleeve 28 to pass freely therethrough into press-fit engagement with the first end section 174 of the bore 160. This forcibly mounts the second end 156 of the cartridge 29 in the cylindrical portion 162 of the holder 164 and brings the tabs 26 at the second end 156 of the outer sleeve 28 into secure electrical contact with the inner surface of the bore 160.

Figure 17:
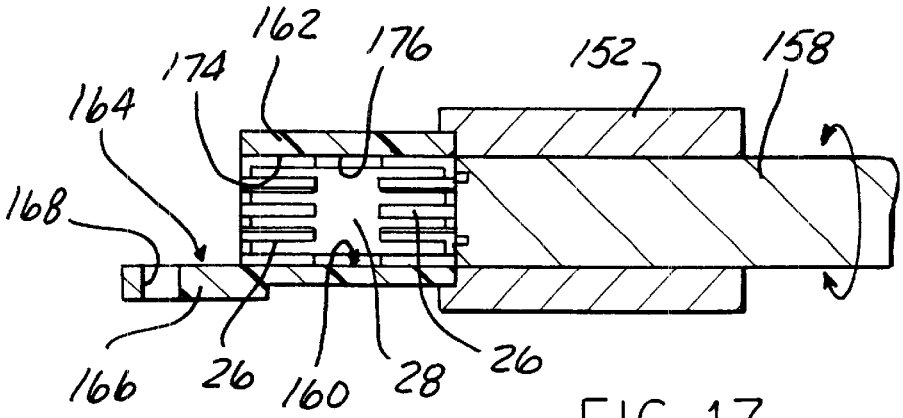
Figure 18:
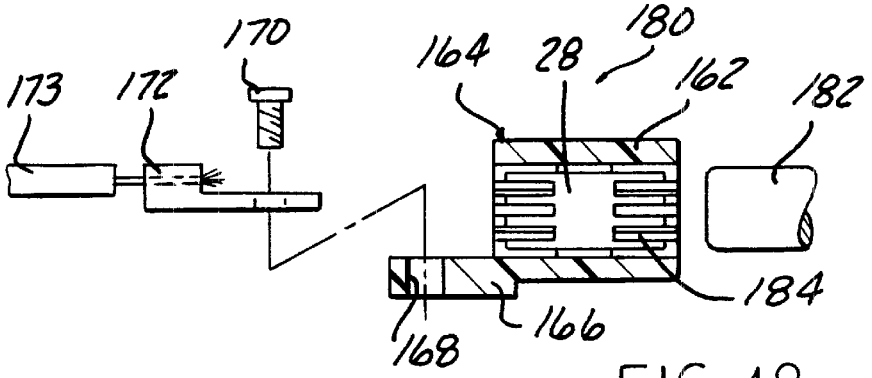
FIG. 18 is an exploded, partially cross section, side elevational view of the completed electrical connector constructed according the method of FIGS. 14–17 shown in a use, interconnected application.

The cartridge 29 is forcible inserted into the bore 160 until the entire inner sleeve and folded over tabs 26 at the first end 150 of the cartridge 29 are fully enclosed within the bore 160 as shown in FIG. 17.

As described above, the second end section 176 of the bore 160 has a larger inner diameter than the adjacent first end section 174. This can be formed in a number of constructions, including a gradual decreasing diameter taper along the length of the bore 160 from the first end section 176 to the second end section 178. Alternately, a step may be formed intermediate the ends of the cylindrical portion 162 to form two different diameter sections, one for the first end section 174 and the other for the second end section 176 of the bore 160.

As shown in FIG. 17, when the cartridge 29 is fully inserted into the bore 160, the second end 156 of the cartridge 29 and the folded over tabs 26 carried on the second end 156 are in a press-fit engagement with the inner surfaces of the cylindrical portion 162 surrounding the bore 160. However, the tabs 26 at the opposite end of the cartridge 29 will only be loosely disposed between the inner surfaces of the second end section 176 of the bore 160 and the adjacent outer surface of the sleeve 28.

The rotatable tool 158 can be advanced by a suitable drive source, such as a pressurized fluid cylinder, electric motor drive, etc., to slidably urge the first end 150 of the cartridge 29 and the folded over tabs 26 carried thereon from the first housing 156 into the bore 160 in the cylindrical portion 162 of the holder 164.

Next, as shown by the arrow in FIG. 17, the rotatable tool 158 is rotated to angularly offset the tabs 26 at the first end 150 of the cartridge 29 from the corresponding tabs 26 at the second end 156 of the cartridge 29. This provides the desired hyperbolic shape to the strips 24 between the webs 22 on the cylindrical blank as described above. With the rotatable tool 158 held in the rotated position, the end portion of the cylindrical portion 162 of the holder 164 surrounding the second end section 176 of the bore 160 is subjected to a swaging operation which deforms the end portion of the cylindrical portion 162 and decreases its inner diameter to bring the inner diameter of the end portion of the cylindrical portion 162 into tight, close fitting engagement over the tabs 26 at the first end 150 of the outer sleeve 28 so that the tabs 26 are tightly held between and in contact with the outer surface of the sleeve 28 and the inner surface of the bore 160. The rotatable tool 158 is then withdrawn along with the first housing 152 leaving the completed connector denoted by reference number 180 in FIG. 18.

As described above, a terminal 172 carrying an electrical conductor 173 may be securely attached to the aperture 168 in the support 166 of the holder 164 by means of a threaded fastener or screw 170 which extends through the support 166 into an underlying mount 167. An elongated, cylindrical pin 182 may be releasibly inserted into the interior of the barrel socket 184 to couple the electrical device or circuit to which the pin 182 is attached with the circuit or conductors or electrical device to which the conductor 173 and terminal 172 are connected via the socket 184 and the holder 164.

Figure 11:
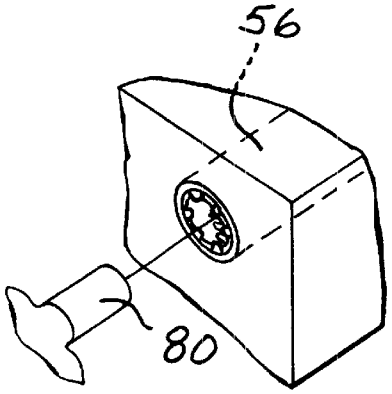
FIG. 11 is an exploded perspective view of the barrel mounted in a use device and receiving a conductive pin.

FIG. 11 depicts a barrel socket 56, constructed as described above, mounted in a electrical use device, such as a battery, alternator, etc.

Figure 12:
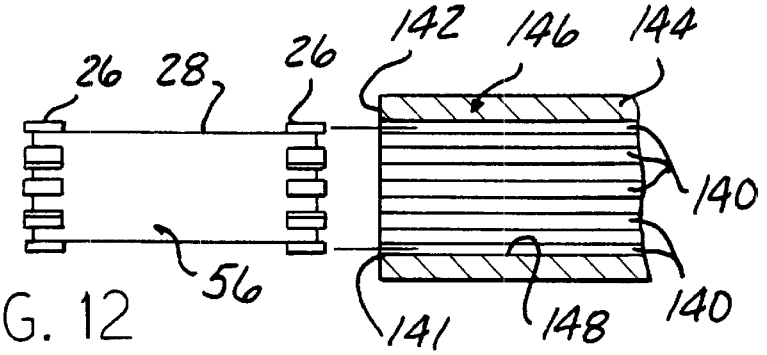
FIG. 12 is a longitudinal, cross-sectional view of an alternate embodiment of a barrel terminal according to the present invention.
Figure 13:
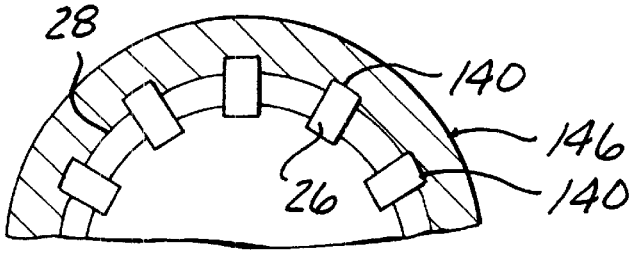
FIG. 13 is an enlarged, partial end view of the assembled barrel terminal of the embodiment shown in FIG. 9.

Referring now to FIGS. 12 and 13, there is depicted another aspect or embodiment of the present invention which includes a plurality of elongated splines or grooves 140 which extend longitudinally between opposite ends 142 and 144 of a use device, holder or support 146.

It will be understood that although the holder 146 is depicted as being a separate, stand alone element, the entire structure of the holder 146 may be incorporated into a larger electrical use device, such as an alternator, battery, etc. without the use of a separate external cylindrical sleeve containing the splines or grooves 140. Rather, the splines or grooves 140 may be simply formed in a suitably sized bore in the use device.

Further, in FIG. 12, the barrel socket 56 is depicted without the surrounding first and second holders 30 and 40 which are required to hold the tabs 26 in the folded over, clamped position in engagement with the outer surface of the sleeve 28 prior to insertion into the bore 148 in the holder 146.

The grooves or splines 140 have a generally square cross section sized to non-rotatably receive the folded over tabs 26 at each end of the barrel socket 56 when the pusher 74 pushes the barrel socket 56 from the aligned first and second housings 30 and 40. Although the tabs 26 at one end of the barrel socket 56 are angularly, rotatably offset from the originally coaxial tabs 26 at the opposite end of the sleeve 28, the first set of tabs 26 are rotated sufficiently to bring the tabs 26 at the opposite end of the sleeve 28 into coaxial alignment. This ensures that the tabs 26 at each end of the barrel socket 56 are engageable with the grooves or splines 140 in the holder 146.

The forward ends of the splines 140 can be provided with an outwardly tapered edge 141 to guide the tabs 26 into one of the splines 140 as shown in FIG. 12.

The grooves or splines 140 further resist movement of the rotatably offset tabs 26 at either end of the sleeve 28.

Figure 19:
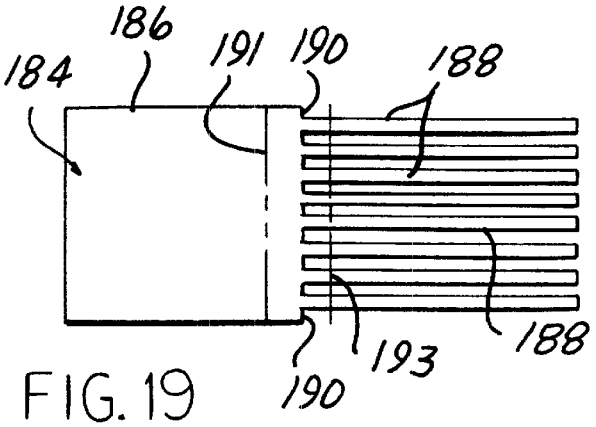
FIGS. 19–21 depict sequential steps in the construction method of the present invention for an alternate barrel socket.
Figure 20:
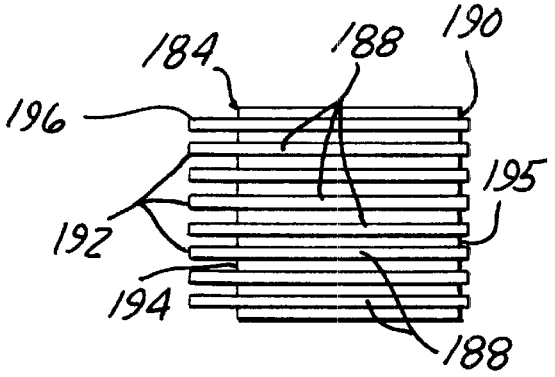
Figure 21:
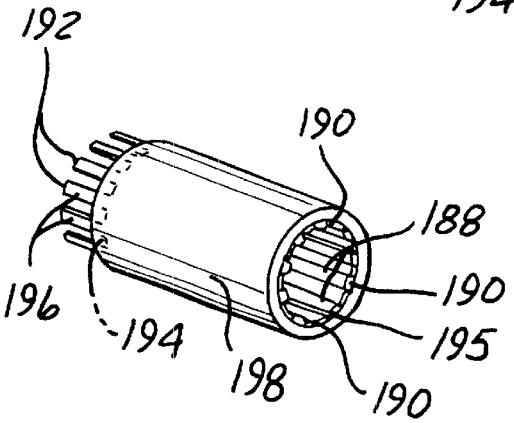

An alternate method of constructing the blank 20 and outer sleeve 28 described above and shown in FIGS. 1–4 as a unitary, one piece member is depicted in FIGS. 19–21.

In this aspect of the present invention, a one piece sheet metal blank 184 is formed with a first generally rectangular, solid end portion 186 and a plurality of elongated, generally flat strips 188, by stamping, machining, etc. The strips 188 extend longitudinally from one end of the solid end portion 186 and are equally spaced apart and disposed in parallel. The entire blank 184 may be formed of a suitable electrically conductive material, such as beryllium copper.

According to another aspect of the invention, the strips 188 are originally separate from the solid end portion 186 but are unitarily joined to one end of the solid end portion 186 at a first end 190 by welding.

Next, all of the strips 188 are bent or folded over the second end 195 of the solid end portion 186 about the first end 190 and remain in parallel as shown in FIG. 20. As shown therein, the free ends 192 of each of the strips 188 extend beyond a first end 194 of the solid end portion 186. The portion of the strips 188 projecting beyond the first end 194 form tabs 196.

Next, as shown in FIG. 21, the solid end portion 186 is then folded into a cylindrical sleeve 198 and the edges welded or otherwise fixedly joined together. The folding operation carries the strips 188 overlaying one surface of the solid end portion 186 such that the strips 188 are now disposed within the interior of the resulting cylindrical sleeve 198 as shown in FIG. 21. The tabs 196 still project outward beyond the first end 194 of the sleeve 198.

At this point in the construction of the sleeve 198, the second end 195 may be inserted into tight engagement with a bore in a holder, as described above. The tabs 196 may be folded over the outer surface of the sleeve 198 and secured in the bore of a holder as described above and shown in FIG. 10 by either of the previously described construction methods.

Figure 22:
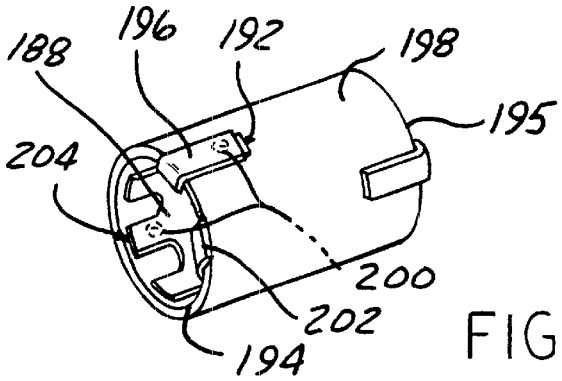
FIG. 22 is a perspective view showing multiple means for fixedly mounting the tabs of the contactor to the sleeve.

However, FIG. 22 depicts alternate methods for securely affixing the tabs 196 to the sleeve 198. FIG. 22 depicts three different attachment locations or methods for attaching the tabs 196 or an end portion of the tabs 196 or the strips 188 to the outer sleeve 198. All three are depicted in a single sleeve 198 merely for convenience, it being understood that in an actual construction, only one attachment method would normally be employed for all of the strips 188 and tabs 196.

The different attachment methods share a common feature in that the tabs 196 or end portions of the strips 188 are fixedly secured to the sleeve 198 by welds. Since the weld cannot significantly increase the thickness of the tab 196 or strip 188, in one aspect, a slight depression or aperture 200 can be formed at the end portion of the tabs 196 or strips 188 at the location of each weld.

Thus, according to one aspect of the invention, the tabs 196 are folded over the first end 194 of the sleeve 198 as in the above described embodiments of the invention and then welded to the outer surface of the sleeve 198. Alternately, the tabs 196 can be shortened so as to define a portion 202 which has a length only foldable over the first end 194 of the sleeve 198.

According to another aspect of the present invention, the strips 188 are formed without any tabs 196 such that the strips 188 terminate in an end 204 within the bore in the sleeve 198 adjacent to the first end 194 of the sleeve 198.

Regardless of which construction technique is employed, the end result is that the strips 188 are maintained in parallel at the first end 194 of the sleeve 198 and fixedly secured thereto after the freely movable end portions of the strips 188 at the first end 194 of the sleeve 198 have been rotated the desired amount as in the construction methods described above.

Rather than fixedly attaching the ends of the strips 188 or the tabs 196 at the end of the strips 188 to the sleeve 198, an annular collar or outer barrel may be employed as described in the patents incorporated herein by reference to securely maintain the folded over tabs 196 in a fixed, rotated position with respect to the opposite ends of the strips 188.

It is also possible in the construction shown in FIG. 19 to construct the strips 188 of a different conductive material than the material forming the solid end portion 186. In this manner, the solid end portion 186 which forms the cylindrical sleeve 198 may be formed of a lower cost material, such as brass; while the strips 188 which form the main contact area of the socket, are formed of a more suitable electrically conductive material, such as beryllium copper. In such a construction, the first end 190 of the strips 188 are securely fixed to the end 195 of the solid end portion 186, preferably by welding the first end 190 of each strip 188 to the end 195 of the solid end portion 186.

The use of individual strips 188 which are then fixedly secured to the solid end portion 186 also can be used to reduce manufacturing costs by eliminating the scrap normally associated with stamping the blank 20 or the blank 184 as described above from a single sheet. The individual strips 188 can be formed of flattened wire thereby eliminating scrap in forming the unitary sleeve 198 and the strips 188.

This aspect of the present invention also reduces part count in constructing the sockets since the cylindrical sleeve and strips can be unitarily formed as a one piece member thereby eliminating the need for a separate sleeve and a separate blank carrying the contact strips and end tabs.

Figure 23:
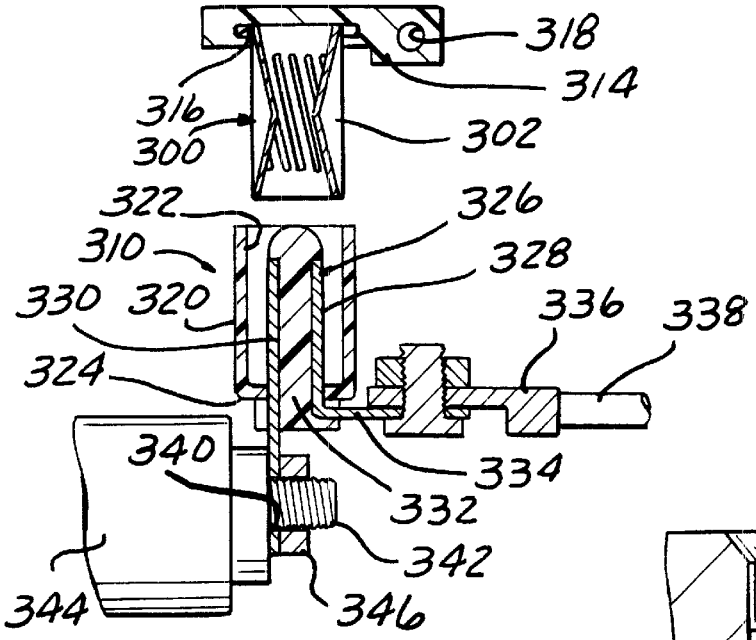
FIG. 23 is an exploded, side elevational, cross-sectional view showing the electrical connector of the present invention employed as a power disconnect.

Referring now to FIG. 23, there is depicted an electrical disconnect apparatus using a radially resilient contact 300 or connector constructed according to any of the above-identified construction methods or the methods disclosed in U.S. Pat. Nos. 4,657,335 and 4,734,063.

In this aspect of the invention, it is preferred that the contact 300 be provided with an outer sleeve 302 which may be formed as a single continuous sleeve or two separate, substantially end-to-end registered end caps. One end of the electrical contact 300 is fixedly mounted in a cover 314, such as a molded plastic cover, having engagement tabs 316 which fixedly engage one end of the electrical contact 300.

An aperture 318 is formed at one end of the cover 314 for receiving a lanyard or other release actuator to provide for manual separation of the contact 300 from the mating disconnect 310.

The disconnect 310 includes a generally cylindrical housing 320 having an open end 322 and an opposed closed end 324. Drain holes, not shown, may be formed in the closed end 324 to allow water to flow out of the housing 320 in applications in which the open top end 322 is disposed in a generally upward facing, vertical direction.

A non-conductive pin denoted generally by reference number 326 is fixedly mounted within the housing 320 by any suitable means, such as integral molding with the electrical insulating material preferably used to form the housing 320, or by mechanical fasteners, etc.

As shown in FIG. 23, the pin 326 has an overall circular cross section. A pair of C-shaped, split shell contacts 328 and 330 form opposite outer sides of the pin 326 and have spaced ends. The contacts 328 and 330 are spaced apart by an electrically insulating core 332 which holds the contacts 328 and 330 in a fixed position. Preferably, the contacts 328 and 330 and the core 332 are insert molded into the unitary, one-piece pin 326.

The contact 328, in the particular application shown by example only in FIG. 23, has a distal leg 334 which projects angularly, such as perpendicularly, from the main body of the contact 328. An aperture is formed in the outer end of the distal leg 334 for receiving a fastener to connect the leg 334 as well as the electrical contact 328 to a connector 336 at one end of a battery cable 338 is connected at the other end to a vehicle battery.

The other contact 330 has an elongated distal end 340 carrying an aperture for receiving a lug 342 extending from one end of an electrical use device, such as a vehicle starter, or solenoid switch shown generally by reference number 344. The aperture in the distal end 340 of the contact 330 is mounted over the lug 342 and secured in place by means of a nut or other fastener 346.

In the orientation shown in FIG. 23, it can be seen that the contact 328 is electrically connected through the cable 338 to a vehicle battery, not shown. Similarly, the opposed contact 330 is connected to the electrical use device or starter 344. Since the opposed side edges of the contacts 328 and 330 are spaced apart and separated by the electrically insulating material of the core 332, the electrical use device or starter 344 is electrically disconnected from the vehicle battery. However, when the electrical contact 300 is urged into the housing 320, the electrical conductive strip within the contact 300, as described above, contacts and electrically connects the two contacts 328 and 330 in the pin 326 thereby completing an electrical circuit from the vehicle battery through the battery cable 338, the contact 328, the conductive strip in the contact 300, the contact 330 to the electrical use device, such as the vehicle starter 344.

As a safety device or as a vehicle anti-theft device, a lanyard, not shown, connected to the cover 316 may be pulled to separate the contact 300 from the pin 326 thereby electrically disconnecting the starter 334 from the battery.

The use of the separable cover 316 and contact 300 may have other applications wherein the cover, or just the contact 300 itself, is connected to a movable member which is capable of at least separating the contact 300 from the pin 326 in certain situations. For example, the movable member could be connected to an actuator responsive to a sensor on a vehicle which detects a vehicle rollover. Upon detecting such a rollover event, the movable member will be activated separating the contact 300 from the pin 326 and thereby discontinuing electrical power from the vehicle battery to the starter 344 and possibly the entire electrical system and accessories in the vehicle.

Figure 25:
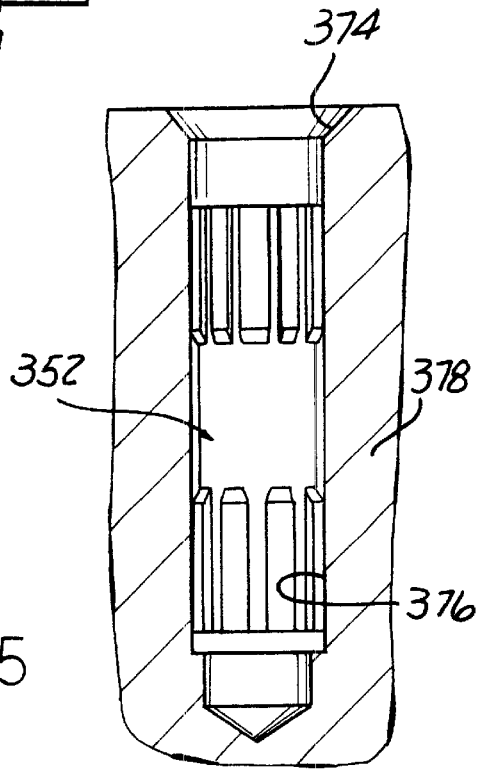
FIG. 25 is an enlarged, partially cross- sectioned view showing the contact cartridge of FIG. 24 mounted in the housing.
Figure 24:
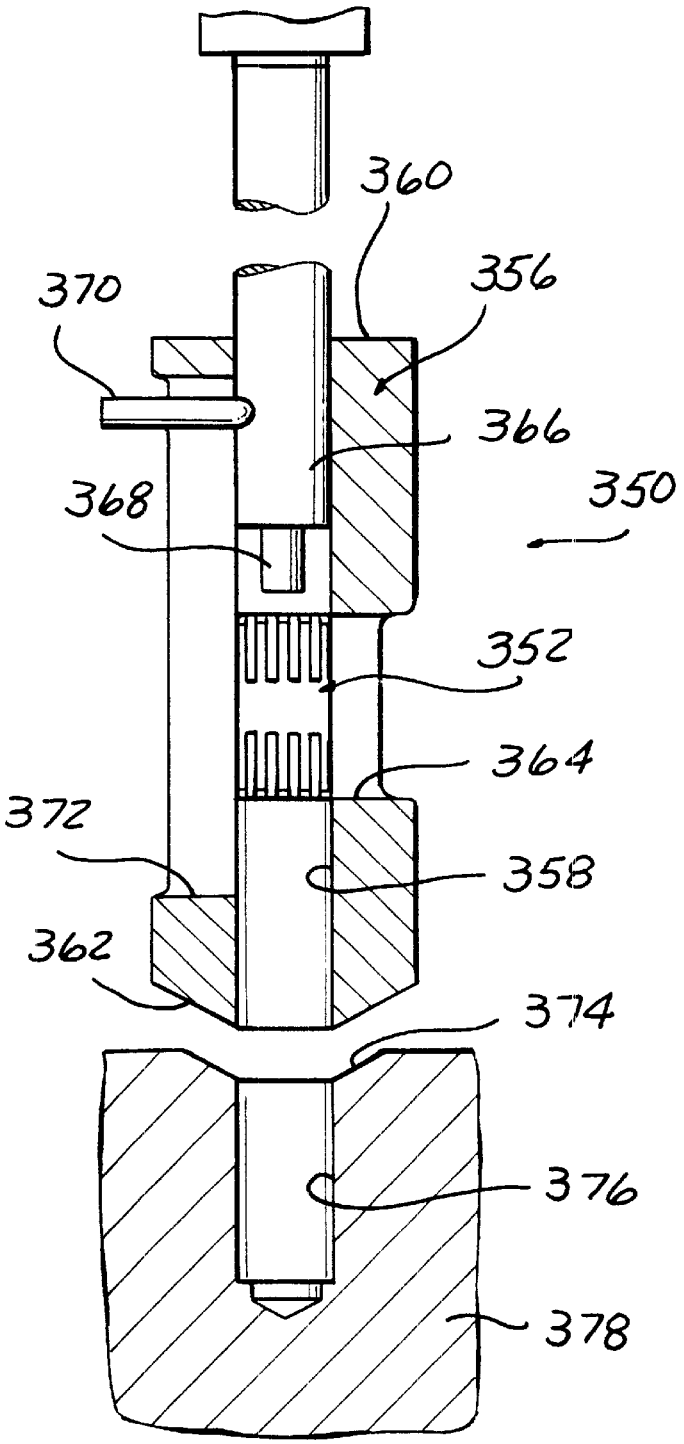
FIG. 24 is an exploded, elevational, cross-sectional view showing an insertion tool for mounting the contact cartridge of the present invention in a housing.

Referring now to FIGS. 24 and 25, there is depicted an insertion tool 350 which can be used to field mount a resilient electrical contact cartridge 352, constructed as described above without an outer sleeve as the tabs are welded to the inner sleeve 28.

The insertion tool 350 has a one-piece body 356 with a main through bore 358 extending between a first end 360 and an opposed, second end 362. A transversely extending side bore 364 intersects the main bore 358 and provides an opening for insertion of the cartridge 352 into the main bore 358.

A slidable insertion pin 366 is slidably mounted in the main bore 352 through the first end 360 of the body 356 and has a smaller diameter guide end 368 formed thereon which is engageable with the interior bore in the cartridge 352. A manual retract lever 370 is connected to the insertion pin 366 and slides within a slot 372 formed in the body. The lever 370 provides for manual retraction of the insertion pin 366 to its home position shown in FIG. 24.

The second end 362 of the body 356 is beveled or angled as shown in FIG. 24 for aligning the second end 362 of the body 356 with a similarly beveled opening 374 leading to a bore 376 in a housing 378, which is to be understood to be representative of an electrical use device, such as vehicle starter, alternator or any other electrically operated component.

In operation, the insertion pin 356 is retracted to the home position adjacent the first end 360 of the body 356 through use of the manual retract lever 370. A new cartridge 352 is inserted through the side bore 364 into the main bore 358. The body 356 is then aligned with the beveled opening 374 in the housing 378. An insertion force through use of a suitable force generating mechanism, such as a press ram, is exerted on the outer end of the insertion pin 366 to forcibly urge the pin 366 through the main bore 358 and to slide the cartridge 352 from its loaded position in the body 356 into the bore 376 in the housing 378 as shown in FIG. 25.

Figure 26:
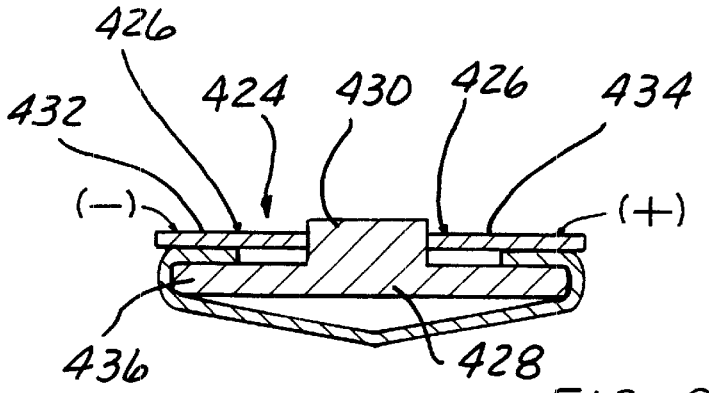
FIG. 26 is a side elevational, longitudinal cross-sectional view showing another embodiment of the present electrical connector employed as a heater.

Referring now to FIG. 26, there is depicted the use of the electrical connector of the present invention as a heat generating source or device for supplying heat to a pin inserted into the electrical connector denoted generally by reference number 424. In this aspect of the invention, the connector 424 may be constructed according to any of the above described methods and include or not include an outer sleeve. It will be understood that the outer cylindrical or sleeve member 426 shown in FIG. 26 is representative of a single continuous elongated outer sleeve with a discontinuity in a center portion, or two end caps having spaced ends or a single enlarged housing or holder having an annular recess adjacent a center portion of the connector 426 and carrying an electrical insulating member in the recess.

In this aspect of the invention, the inner barrel 428 is formed of a electrical insulating material, such as suitable high strength plastic. The inner barrel 428 has as a unitary part thereof or is connected to an outwardly extending projection 430, also formed of an electrically insulating material. The projection 430 extends between opposed ends 432 and 434 of the outer sleeve 426 which are electrically isolated from each other by the projection 430. Each of the ends 432 and 434 is connected to opposite sides of an electrical circuit. This arrangement provides an electrically conductive path from the end portion 434 which is depicted, by example, as being connected to a positive side of an electrical power source, through the electrically conductive strip 436 of the connector 424 to the opposed end 432 which is connected to the negative side of circuit. Due to the resistance of the conductive material forming the conductive strip 436, heat is generated along the length of the strip 436 and radiated to the interior bore within the connector 424. This heat is supplied to a pin or other member inserted into the bore in the connector 424 thereby heating the inserted pin or member.

Referring now to FIGS. 27–31, there is depicted an alternate method for constructing an electrically resilient contact or connector according to the present invention. In this embodiment, by example only, a terminal 440 is provided with a generally annular, cup-shaped recess 442. The recess 442, hereafter referred to as a cup, may have an optional through hole extending through a lower end thereof.

The interior diameter of the cup 442 is sized to receive and fixedly hold one end of the cartridge 29, with the other end of the cartridge 29 projecting outwardly from the cup 442 above the surface of the terminal 440. In this preassembled state, the tabs 26 on the outer end of the cartridge 29 have not yet been disposed at an angular offset position with respect to the tabs 26 at the other end of the cartridge 29 which are fixedly held against rotation in the cup 442 by a press or interference fit. Next, a cap 444 is mounted over the outer end of the cartridge 29. The cap 444 has a cylindrical body 446 with an aperture 448 at one end. An outwardly, radially extending flange 450 projects from the one end of the body 446 opposite from the end containing the aperture 448. The flange 450 is provided with one of a number of different mounting means for securely mounting the cap 444 in a predetermined fixed, rotated position with respect to the terminal 440 and the cup 442.

Figure 28:
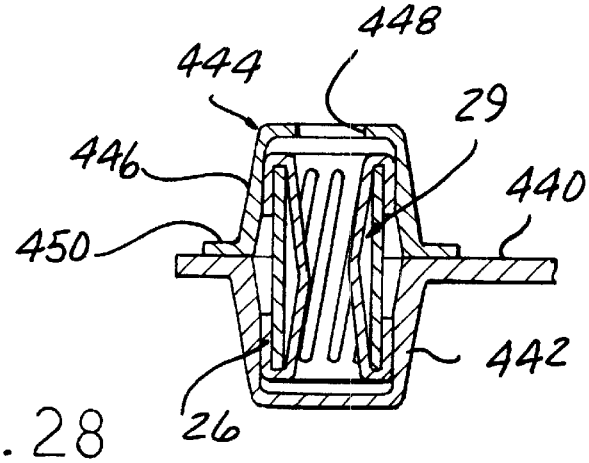
FIG. 28 is a cross-sectional view generally taken along line 28—28 in FIG. 27.

The cap 444 is inserted over the outer end of the cartridge 29. As shown in FIG. 28, the cylindrical body or side wall 446 of the cap 444 may be disposed at a slight inward angle so as to engage the ends of the tabs 26 on the outer end of the cartridge 29 in a press fit. Next, the cap 444 is rotated a predetermined amount relative to the terminal 440, such as 15° to 45°. Due to the fixed engagement of the tabs 26 on the outer end of the cartridge 29 with the inner surface of the cap 444, the tabs 26 on the outer end of the cartridge 29 are also rotated through the same angle as the cap, such as 15° to 45° according to a preferred aspect of the present invention. This rotation disposes the conductive strips of the contactor in the cartridge 29 at the predetermined angle creating the hyperbolic curve between opposite ends of the conductive strips as described above.

Figure 27:
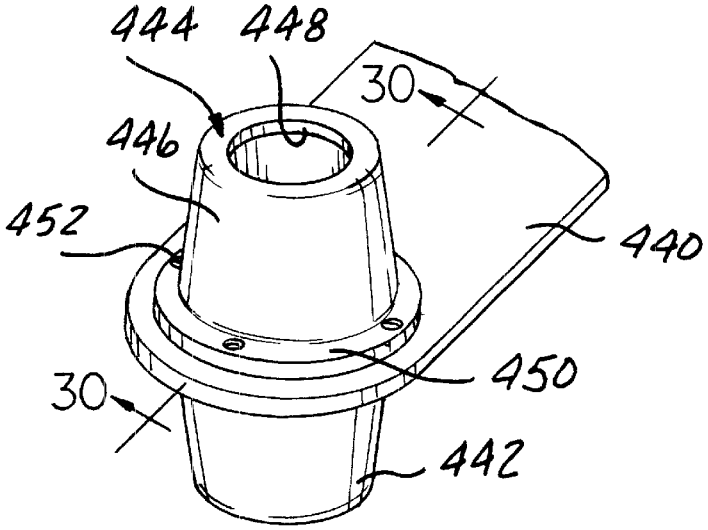
FIG. 27 is a perspective view showing a connector according to another embodiment of a method for constructing the electrical connector of the present invention.

With the cap 444 in the desired rotated position, means are provided for fixedly mounting the cap 444 to the terminal 440. One example of a mounting means is shown in FIG. 27 in the form of apertures 452 in the mounting flange 450 of the cap 444. The apertures 452 provide a suitable location for a weld, preferably an ultrasonic weld, to fixedly hold the cap 444 in the desired rotated position with respect to the terminal 440. Welds may also be formed at other locations, such as between adjoining edges of the mounting flange 450 and the terminal 440.

Mechanical fasteners may also be employed in apertures 452 formed in mounting flange 450 of the cap 444 and mating apertures in the surface of the terminal 440. Further, indicia may be provided on the terminal 440 and/or on the mounting flange 450 of the cap 444 to provide an indication of the amount of rotation of the cap 444 from a starting position relative to the terminal 440.

Figure 29:
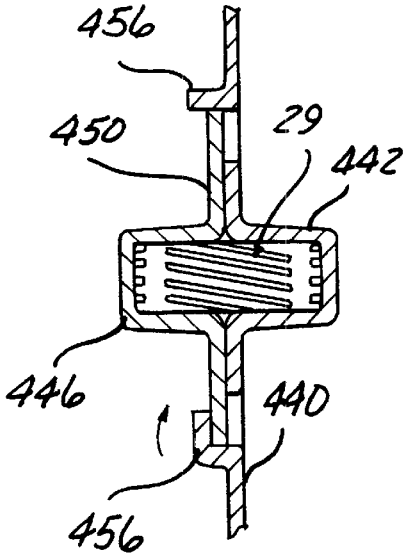
FIG. 29 is a cross-sectional view, similar to FIG. 28, but showing an alternate cap locking mechanism according to the present invention.

FIG. 29 depicts an alternate mounting means in which at least one and preferably a plurality of tabs 456 are stamped or otherwise pressed out of the surface of the terminal 440 at circumferentially spaced positions adjacent the outer peripheral edge of the mounting flange 450 of the cap 444.

After the cap 444 has been rotated the desired angular amount relative to the terminal 440, the tabs 456 are bent over the adjoining surface of the mounting flange 450 of the cap 444 and crimped or otherwise secured in a fixed relationship with the mounting flange 450 to hold the cap 444 in the desired rotated position on the terminal 440.

Figure 30:
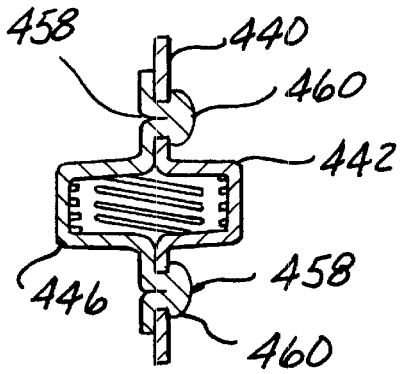
FIG. 30 is a cross-sectional view, similar to FIG. 28, but showing yet another embodiment of a cap lock mechanism according to the present invention.

In FIG. 30, the mounting means comprises a plurality of locks 458 which are circumferentially spaced about the peripheral edge of the mounting flange 450 of the cap 444 and project away from the cylindrical sidewall 446 of the cap 444. Each lock 458 has an enlarged head 460 which is formed by forcibly urging overlapping portions of the flange 450 and the terminal 440 into a spherical die cavity below the terminal 440 to form the enlarged head 460 which locks the terminal 440 and the flange 450 together in the desired angular offset position. The number of locks 458 used is chosen based on the force requirements of an application. The locks 458 may be equidistantly spaced by example only.

Figure 31:
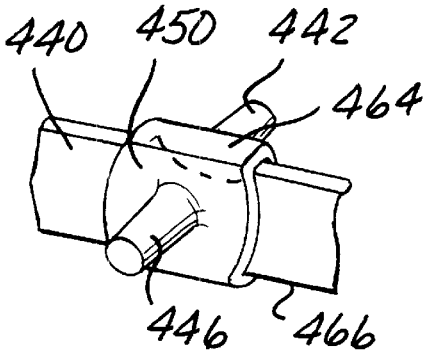
FIG. 31 is a perspective view of yet another embodiment of a cap lock mechanism according to the present invention.

In FIG. 31, another aspect of the mounting means is depicted in which the mounting flange 450 of the cap 444 is provided with at least two and possibly a plurality of radially outward extending enlargements or tabs 464. Preferably the tabs 464 are arranged in diametrically opposed pairs about the circumference of the mounting flange 450.

In this aspect of the invention, after the cap 444 has been rotated the desired angular amount relative to the terminal 440, two diametrically opposed tabs 464 which are disposed over edges 466 of the terminal 440 are bent down and over the terminal 440 to lock the lock the cap 444 to the terminal 440.

Figure 33:
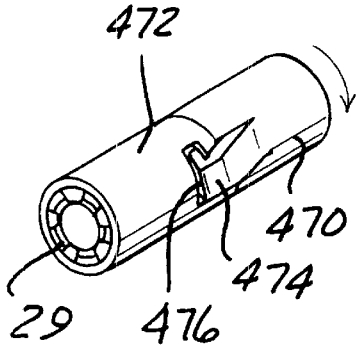
FIG. 33 is a perspective view showing the electrical connector of the FIG. 32 in a locked position.
Figure 32:
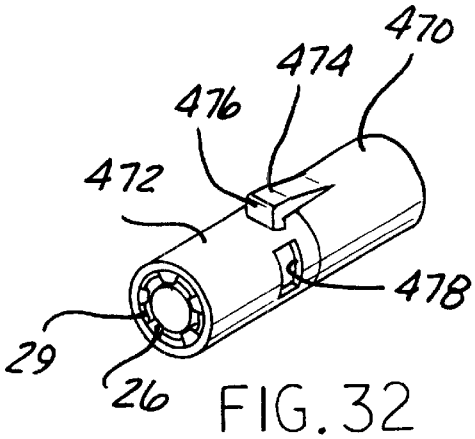
FIG. 32 is a perspective view depicting yet another method for constructing the electrical connector of the present invention, where the connector is shown in a prelocked, first assembly step position.

Finally, FIGS. 32 and 33 depict an alternate means for locking the tabs 26 at opposite ends of the cartridge 29 in an angularly offset position. This embodiment of the cartridge 29 is similar to the electrical contact described in U.S. Pat. Nos. 4,657,335 and 4,734,063 in which end caps or outer barrels 470 and 472 are mounted over the tabs 26 at opposite ends of the cartridge 29. In this aspect of the invention, the outer barrels 470 and 472 are mounted in fixed engagement with the respective tabs 26 at opposite ends of the cartridge 29 prior to imparting a rotative twist or angular offset between the opposing tabs 26.

Further, according to this aspect, the outer barrel 470 is provided with at least one and preferably two diametrically opposed, and possibly even three lock arms 474 each having a depending tab 476 at an outer end. The lock arms 474 and tabs 476 project outwardly over one end of the outer barrel 470.

The other outer barrel 472 has mating apertures 478. The apertures 478 have a size and shape complementary to the size and shape of the tab 476 on the lock arms 474. Further, a larger number of apertures 478 may be provided in the outer barrel 472 to accommodate different angular offsets between the opposing tabs 26 in the cartridge 29.

In assembling the connector shown in FIGS. 32 and 33, after the outer barrels 470 and 472 have been slidably urged over the tabs 26 at opposite ends of the cartridge 29, one of the outer barrels, such as outer barrel 470, is held in a stationary, fixed position, typically in a suitable holding fixture, not shown. The other barrel 472 which is disposed in a fixed, non-movable relationship with the tabs 26 on the inner disposed cartridge 29 is then rotated relative to the barrel 470 through a predetermined angle, such as preferably 15° to 20°. When the desired angular offset is obtained, the tabs 476 on the lock arms 474 should be disposed over and can be brought into engagement with the apertures 478 in the outer barrel 472 to lock the outer barrel 472 in the desired angular offset position with respect to the barrel 470.

The tabs 476 may take any suitable shape, such as tabs having an inturned lip which snaps through a lip in each aperture and under the inner surface of the outer barrel 472. The lock arms 474 are provided with a spring force to enable movement between unlocked and locked positions.

What is claimed:

1. A connector assembly comprising:

a connector including a cylindrical sleeve;

an electrically conductive contact member coaxially received within the sleeve, the contact member including:

a plurality of circumferentially spaced strips having first and second ends, one of the first and second ends of each strip being angularly offset with respect to a longitudinal axis of the sleeve from the opposed ends of the respective strip;

the first and second ends of the strips non-moveably fixed in the angularly offset position with respect to the sleeve; and an electrical disconnect, the disconnect including:

two electrical contacts spaced apart by an insulating member;

a housing surrounding the spaced contacts and defining a cavity between the housing and the space contacts; and the connector releasably insertable into the housing to electrically connect the two contacts by the contact member.

2. The connector of claim 1 further comprising:

the first contact connected to a first external electrical circuit; and the second electrical contact connected to a second external electrical circuit.

3. The connector of claim 2 further comprising:

an insulating member connected to the connector.

4. A connector assembly comprising:

a connector, including a cylindrical sleeve;

a contact member coaxially received within the sleeve, the contact member including:

a plurality of circumferentially spaced strips having first and second ends, one of the first and second ends of each strip being angularly offset with respect to a longitudinal axis of the sleeve from the opposed ends of the respective strip; and the first and second ends of the strips non-moveably fixed in the angularly offset position with respect to the sleeve;

a terminal, the terminal having a recess with a closed end and an open the cylindrical sleeve with the contact member axially mounted at the first end of the strips in the recess;

a cap having an open end;

the cap fixedly receiving the second ends of the strips and angularly rotatable with respect to the terminal to angularly offset the first and second ends of the strip in the connector; and means for fixedly mounting the cap to the terminal in the angularly rotated position.

5. A connector assembly comprising:

a connector, including a cylindrical sleeve;

a contact member coaxially received within the sleeve, the contact member including:

a plurality of circumferentially spaced strips having first and second ends, one of the first and second ends of each strip being angularly offset with respect to a longitudinal axis of the sleeve from the opposed ends of the respective strip; and the first and second ends of the strips non-moveably fixed in the angularly offset position with respect to the sleeve;

a terminal, the terminal having a recess with a closed end and an open end;

the cylindrial sleeve with the contact member axially mounted at the first end of the strips in the recess;

a cap having an open end;

the cap fixedly receiving the second ends of the strips and angularly rotatable with respect to the terminal to angularly offset the first and second ends of the strip in the connector; and means for fixedly mounting the cap to the terminal in the angularly rotated position, the mounting means including a plurality of welds between the cap and the terminal.

6. The connector of claim 5 wherein the mounting means comprises:

a mounting flange surrounding the open end of the cap;

a plurality of apertures in the mounting flange; and the welds formed in the apertures.

7. A connector assembly comprising:

a connector, including a cylindrical sleeve;

a contact member coaxially received within the sleeve, the contact member including:

a plurality of circumferentially spaced strips having first and second ends, one of the first and second ends of each strip being angularly offset with respect to a longitudinal axis of the sleeve from the opposed ends of the respective strip; and the first and second ends of the strips non-moveably fixed in the angularly offset position with respect to the sleeve;

a terminal, the terminal having a recess with a closed end and an open end;

the cylindrial sleeve with the contact member connector axially mounted at the first end of the strips in the 14 recess;

a cap having an open end;

the cap fixedly receiving the second ends of the strips and angularly rotatable with respect to the terminal to angularly offset the first and second ends of the strip in the connector; and means for fixedly mounting the cap to the terminal in the angularly rotated position, the mounting means including:

a plurality of tabs carried on the terminal, the tabs fixedly engagable with the cap when the cap in the angularly rotated position to fixedly hold the cap in the angularly rotated position.

8. A connector assembly comprising:

a connector, including a cylindrical sleeve;

a contact member coaxially received within the sleeve, the contact member including:

a plurality of circumferentially spaced strips having first and second ends, one of the first and second ends of each strip being angularly offset with respect to a longitudinal axis of the sleeve from the opposed ends of the respective strip;

the first and second ends of the strips non-moveably fixed in the angularly offset position with respect to the sleeve;

a terminal, the terminal having a recess with a closed end and an open end;

the cylindrial sleeve with the contact member axially mounted at the first end of the strips in the recess;

a cap having an open end;

the cap fixedly receiving the second ends of the strips and angularly rotatable with respect to the terminal to angularly offset the first and second ends of the strip in the connector; and means for fixedly mounting the cap to the terminal in the angularly rotated position, the mounting means including:

a mounting flange surrounding the open end of the cap;

a plurality of apertures formed in the mounting flange; and a tab having an enlarged head projecting from the mounting flange, the enlarged head projecting through one aperture in the terminal to fixedly mount the cap to the terminal.

9. A connector assembly comprising:

a connector, including a cylindrical sleeve;

a contact member coaxially received within the sleeve, the contact member including:

a plurality of circumferentially spaced strips having first and second ends, one of the first and second ends of each strip being angularly offset with respect to a longitudinal axis of the sleeve from the opposed ends of the respective strip; and the first and second ends of the strips non-moveably fixed in the angularly offset position with respect to the sleeve;

a terminal, the terminal having a recess with a closed end and an open end;

the cylindrial sleeve with the contact member axially mounted at the first end of the strips in the recess;

a cap having an open end;

the cap fixedly receiving the second ends of the strips and angularly rotatable with respect to the terminal to angularly offset the first and second ends of the strip in the connector; and means for fixedly mounting the cap to the terminal in the angularly rotated position, the mounting means including:

a mounting flange formed on the cap; and at least one tab extending from the mounting flange, the tab bendable about the terminal to fixedly position the cap with respect to the terminal.

10. A connector assembly comprising:

a connector, including:

a cylindrical sleeve; and a contact member coaxially received within the sleeve, the contact member including:

a plurality of circumferentially spaced strips having first and second ends, one of the first and second ends of each strip being angularly offset with respect to a longitudinal axis of the sleeve from the opposed ends of the respective strip; and the first and second ends of the strips non-moveably fixed in the angularly offset position with respect to the sleeve;

the sleeve including:

first and second sleeve portions, each fixedly mountable to one of the first and second ends of the strips, respectively;

an aperture formed in one of the first and second sleeve portions; and a tab having an end releasably engagable with the aperture, the tab formed on the other of the first and second sleeve portions and wherein;

angular rotation of one of the first and second sleeve portions with respect to the other of the first and second sleeve portions to bring the tab into engagement with the aperture fixedly holds the first and second sleeve portions in the angular rotated position, and angularly offsets the first and second ends of the strips relative to each other.

11. A connector assembly comprising:

a connector, including:

a cylindrical sleeve; and a contact member coaxially received within the sleeve, the contact member including:

a plurality of circumferentially spaced strips having first and second ends, one of the first and second ends of each strip being angularly offset with respect to a longitudinal axis of the sleeve from the opposed ends of the respective strip; and the first and second ends of the strips non-moveably fixed in the angularly offset position with respect to the sleeve;

another external sleeve includes first and second electrically spaced sleeve portions;

the cylindrical sleeve having an electrically insulating portion extending radially between the spaced first and second sleeve portions of the external sleeve;

a first electrical circuit connected to the first sleeve portion and the first end of the strips;

a second external electrical circuit connected to the second sleeve portion and the second end of the strips; and wherein an electrical circuit between the first sleeve portion and the second sleeve portion extends serially through the strips and generates heat in the strips and a conductive member inserted into the strips.

* * * * *

UNITED STATES PATENT AND TRADEMARK OFFICE

CERTIFICATE OF CORRECTION

PATENT NO. : 6,482,049 B1
APPLICATION NO. : 09/615290
DATED : November 19, 2002
INVENTOR(S) : Dean D. Swearingen It is certified that error appears in the above-identified patent and that said Letters Patent is hereby corrected as shown below:

Column 3,

Line 9, change “too” to --tool--;
Line 31, change “DRAWING” to --DRAWINGS--.

Column 4,
Line 21, change “cross- sectional” to --cross-sectional--.

Column 7,
Line 53, change “forcible” to --forcibly--.

Column 8,
Line 56, after “etc.” insert a comma --,--.

Column 15,
Line 57, Claim 4, after “open” insert --end;--.

Column 16,
Line 49, Claim 7, change “cylindrial” to --cylindrical--.

Signed and Sealed this

Twenty-first Day of August, 2007

JON W. DUDAS
*Director of the United States Patent and Trademark Office*